United States Patent [19]

Bungo

[11] 4,253,718

[45] Mar. 3, 1981

[54] ELECTRICAL CONNECTOR

[75] Inventor: Edward M. Bungo, Warren, Ohio

[73] Assignee: General Motors Corporation, Detroit, Mich.

[21] Appl. No.: 72,039

[22] Filed: Sep. 4, 1979

[51] Int. Cl.[3] ..... H01R 13/422

[52] U.S. Cl. ..... 339/59 R; 339/195 R; 339/275

[58] Field of Search ..... 339/59, 62, 63, 195, 339/196, 206 P, 217 S

[56] References Cited

U.S. PATENT DOCUMENTS

| | | | |
|---|---|---|---|
| Re. 28,126 | 8/1974 | Poingt | 339/59 R |
| 3,012,159 | 12/1961 | Druesedow | 310/71 |
| 3,065,448 | 11/1962 | Hopkins et al. | 339/217 |
| 3,097,906 | 7/1963 | Shannon | 339/253 |
| 3,530,429 | 9/1970 | Scheller | 339/217 |
| 3,555,496 | 1/1971 | Pearce, Jr. et al. | 339/217 |
| 3,680,035 | 7/1972 | Teagno | 339/59 M |
| 3,693,134 | 9/1972 | Trevisiol | 339/59 M |
| 4,017,141 | 4/1977 | Bury et al. | 339/217 S |
| 4,030,804 | 6/1977 | Enomoto | 339/258 S |
| 4,114,971 | 9/1978 | Heimbrock | 339/59 R |

FOREIGN PATENT DOCUMENTS

| | | | |
|---|---|---|---|
| 1919605 | 11/1969 | Fed. Rep. of Germany | 339/59 R |
| 2704760 | 8/1977 | Fed. Rep. of Germany | 339/59 M |

*Primary Examiner*—John McQuade

*Attorney, Agent, or Firm*—F. J. Fodale

[57] ABSTRACT

An electric connector comprises a connector body and a cable end attached terminal. The connector body has a flexible latch finger which engages a T-shaped lock projection of the terminal to retain the terminal in the connector body. The connector body also includes an integrally hinged flap which maintains the flexible latch finger in a terminal retaining position and which includes a pair of studs which provide a secondary lock for retaining the terminal in the cavity.

4 Claims, 9 Drawing Figures

ELECTRICAL CONNECTOR

This invention relates generally to electric connectors and more particularly to electric connectors comprising a connector body and a cable end attached terminal which is removably retained in the connector body.

In one aspect, this invention is directed to a blade contact terminal of the type disclosed in U.S. Pat. No. 3,555,496 issued to Warren Pearce, Jr. and James L. Winger on Jan. 12, 1971 and pending U.S. patent application Ser. No. 872,474, filed by Harold G. Hawkins and Andrew F. Rodoni on Jan. 26, 1978, now U.S. Pat. No. 4,174,880 both of which are assigned to the assignee of this invention. Each of these blade contact terminals is characterized by a projecting flexible latch tang which is integrally attached to the terminal by means of a flap folded over onto a planar extension of the blade contact. These arrangements have the advantage that the latch tang does not produce a cut-out which reduces the current carrying capacity of the terminal such as the lanced latch tang in the arrangement shown in U.S. Pat. No. 3,530,429 issued to Wilfred Richard Scheller Sept. 22, 1970.

A drawback common to the above arrangements, is that the flexible latch tang is susceptible to damage during handling and assembly of the terminal. Moreover, in each instance the latch tang has the singular function of cooperating with a fixed shoulder in the connector body cavity to prevent terminal pull out.

The object of the terminal aspect of this invention is to provide a blade contact terminal having a flap attached projection for preventing terminal pull out which is relatively stiff and therefore much less sensitive to damage during handling and assembly than the projecting flexible latch tangs of the above noted prior art.

Another object of the terminal aspect of this invention is to provide a blade contact terminal having a flap attached, relatively stiff, projection which functions to prevent oven-insertion as well as terminal pull out.

A feature of the terminal aspect of this invention is that the relatively stiff projection is attached to a longitudinal edge of the flap and consequently the terminal has a strong transition between a forward blade contact and a rearward crimp barrel used for cable end attachment.

Yet another feature of the terminal aspect of this invention is that the relatively stiff projection comprises two back-to-back sections which are longitudinally attached to separate flaps which together provide a projection of substantial width which in turn provides a balanced forward stop preventing over-insertion as well as primary and secondary locks preventing terminal pull out.

In another aspect, this invention is directed to a connector body having a flexible latch finger which engages a relatively stiff portion of a terminal received in a terminal receiving cavity of the connector body to retain the terminal therein. Connector bodies equipped with a flexible latch finger for terminal retention are shown for instance in U.S. Pat. No. 3,012,159 issued to Denver Druesedow on Dec. 5, 1961 and U.S. Pat. No. Re. 28,126 issued to Roger Poingt, Aug. 20, 1974. In these arrangements, the flexible latch finger is disposed totally within the terminal receiving cavity and there is nothing to maintain the flexible latch finger in a terminal retaining position other than the finger itself.

Broadly the object of this aspect of the invention is to provide a connector body having a latch finger for terminal retention which incorporates means for maintaining the latch finger in a terminal retaining position.

Another object of the connector body aspect of the invention is to provide a connector body which incorporates means for maintaining the latch finger in a terminal retaining position which is externally accessible for easy operation.

A feature of this aspect of the invention is that the means for maintaining the latch finger in a terminal retaining position fits within the cross section of the connector body for compactness in design.

Another feature of this aspect of the invention is that the means for maintaining the latch finger in a terminal retaining position comprises an integrally hinged flap, which can also be utilized to provide a secondary lock.

Other objects and features of the invention will become apparent to those skilled in the art as the disclosure is made in the following detailed description of a preferred embodiment of the invention as illustrated in the accompanying sheets of drawing in which:

FIG. 5 shows an integrally hinged flap of the connector body in an open position and is taken substantially along the line 5—5 of FIG. 7.

Figure 1:
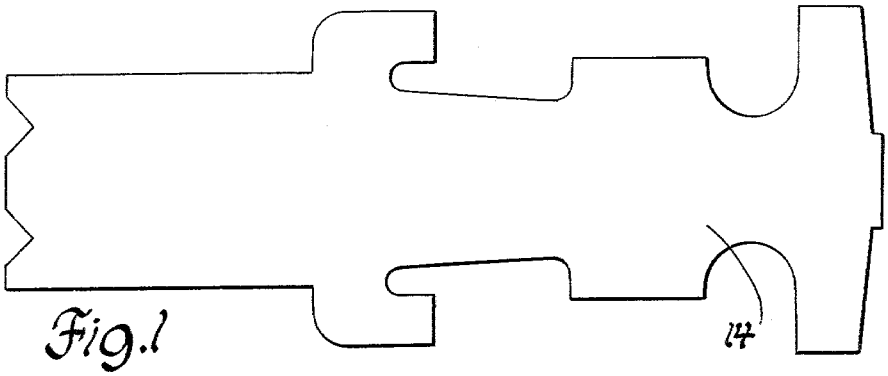
FIG. 1 is a plan view of a blank for making a blade contact terminal in accordance with this invention.
Figure 2:
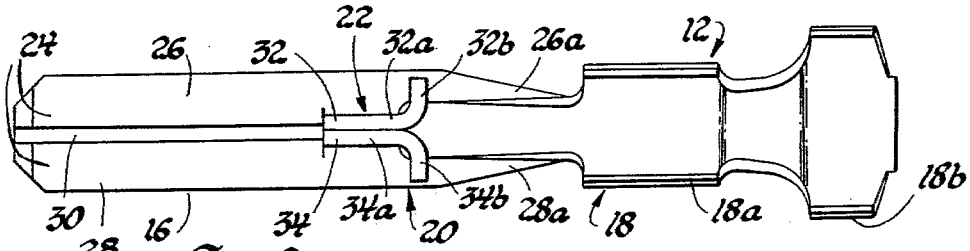
FIG. 2 is a top view of a blade contact terminal in accordance with this invention.
Figure 3:
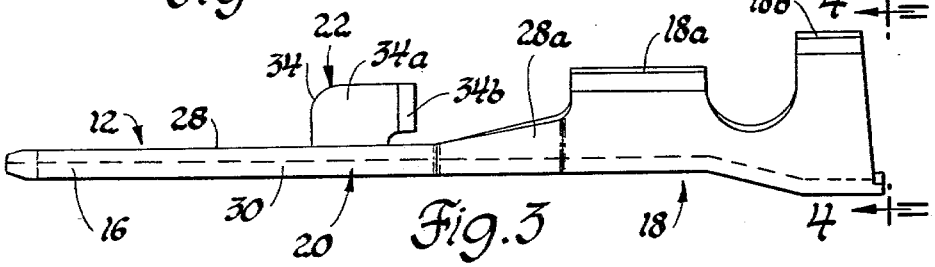
FIG. 3 is a side view of the blade contact terminal shown in FIG. 2.
Figure 4:
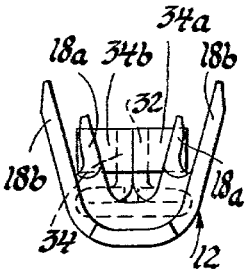
FIG. 4 is a rear view of the blade contact terminal along the line 4—4 of FIG. 3.

Referring now to the drawing and particularly to FIGS. 1–4, there is disclosed a terminal 12 which is stamped and formed from a single piece of single thickness sheet metal stock such as the blank 14 shown in FIG. 1. The terminal 12 comprises a forward blade contact 16, a rearward crimp barrel 18 and a transition 20 connecting the blade contact 16 and the crimp barrel 18.

The blade contact 16 and a contiguous coplanar part of the transition 20 are formed into double thickness by folding opposite marginal edge portions of the blank 14 over a mid portion. This provides a medially split top layer 24 comprised of coplanar side flaps 26 and 28 integrally connected to opposite longitudinal edges of a continuous bottom layer 30.

Figure 5:
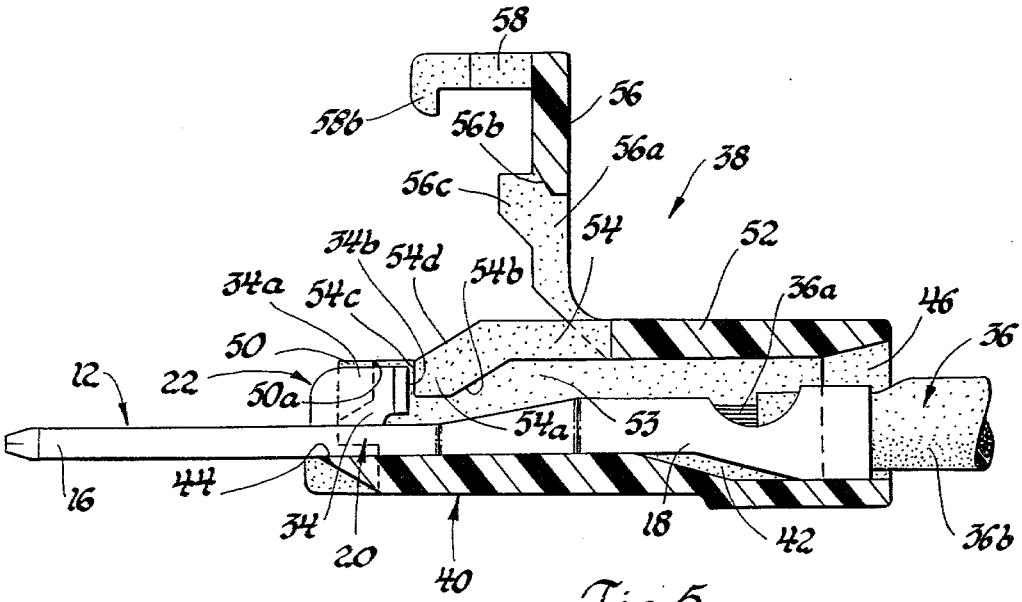
FIG. 5 is a side sectional view of an electric connector comprising a connector body and terminal in accordance with this invention.
Figure 6:
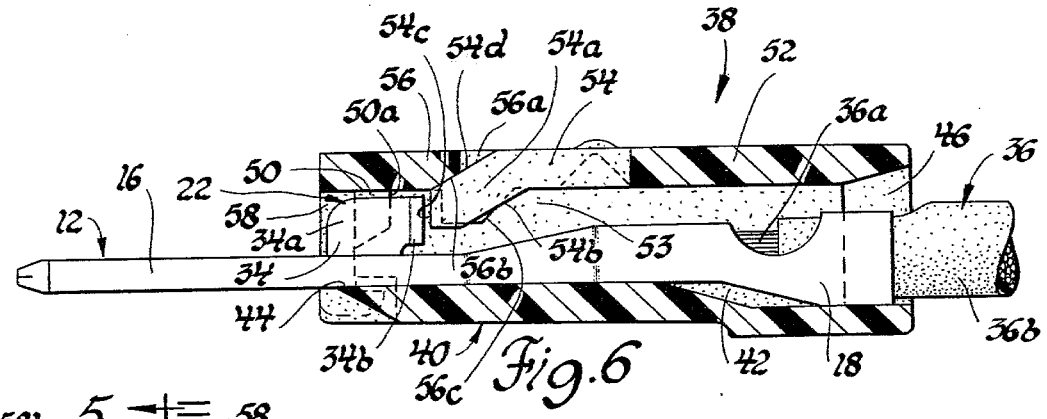
FIG. 6 is also a side sectional view of the electrical connector but it shows the connector body flap in a closed position.

The transition 20 has a relatively rigid lock projection 22 which is an important feature of one aspect of this invention. The lock projection 22 is disposed substantially perpendicular to the blade contact 16 and comprises two L-shaped sections 32 and 34 which are connected to respective portions of the side flaps 26 and 28 forming part of the transition 20. The L-shaped sections 32 and 34 are arranged back-to-back in a T-shaped configuration. The side-by-side section legs 32*a*, 34*a* are integrally connected to the confronting longitudinal edges of the respective side flaps 26, 28 and support the section legs 32*b*, 34*b* which are aligned transversely of the blade contact 16. The crimp barrel 18 attaches the terminal 12 to a cable 36 as shown in FIGS. 5 and 6. It is a standard design comprising pairs of core and insulation crimp wings 18*a*, 18*b* which are respectively crimped around an exposed core end 36*a* and adjacent insulation 36*b* to secure the terminal 12 to the cable 36.

The above arrangement provides a rigid projection of substantial width since the section legs 32*b*, 34*b* together extend nearly the entire width of the terminal. Moreover the terminal has a very strong transition 20 because the rigid projection is attached longitudinally by the section legs 32*a*, 34*a* which permits the side flaps 26, 28 to continue rearwardly and form gussets 26*a* and 28*a* which fair into the core crimp wings 18*a*. Note the substantial width of the portion of the blank shown in FIG. 1 which lies between the L-shaped projections and the core crimp wings.

Referring now to FIGS. 5–8, there is shown an electric connector 38 comprising the blade contact terminal 12 and a connector body 40 which is preferably made of a moldable, relatively hard, plastic material, such as Nylon.

The connector body 40 is elongated and generally rectangular in cross section. It has a longitudinal terminal receiving cavity 42 which extends from a front opening 44 to a rear opening 46. The longitudinal side walls 48 of the connector body 40 have internal tabs 50 which are spaced above the floor of the cavity 42, at the front opening 44. The blade contact 16 passes through the front opening 44 beneath the tabs 50 and the longitudinal, parallel section legs 32*a*, 34*a* pass between the tabs 50 when the terminal 12 is fully inserted into the cavity 42 through the rear opening 46. The rear faces of the tabs 50 provide stop shoulders 50*a* which engage the transverse section legs 32*b*, 34*b* to prevent over-insertion of the terminal 12.

The connector body 40 has a top wall 52 which covers approximately the rear half of the connector body 40 thus providing a large transverse opening 53 into the forward portion of the terminal receiving cavity 42. A flexible latch finger 54 is integrally connected to the top wall 52 and extends forwardly into the transverse opening 53 in cantilever fashion. The connector body 40 is fabricated so that the flexible latch finger 54 normally lies entirely within the plane of the top wall 53 except for a depending end portion 54*a* which projects into the terminal receiving cavity 42 as shown in FIG. 5. The end portion 54*a* includes a rearward facing ramp 54*b* and a forward facing lock shoulder 54*c*. As the terminal 12 is assembled to the connector body 40, the rigid terminal lock projection 22 engages the ramp 54*b* and cams the flexible latch finger 54 upwardly out of the way until the terminal 22 is fully inserted in the cavity 42 whereupon the flexible latch finger 54 returns to its normal position as shown in FIG. 5. In the normal position the lock shoulder 54*c* is disposed behind the rigid terminal lock projection 22 and retains the terminal 12 in the cavity 42 in the pull out direction. The free end of the latch finger 54 has an external beveled surface 54*d* which is used to hold the flexible latch finger 54 in its normal or terminal retaining position as will hereinafter more fully appear.

Figure 7:
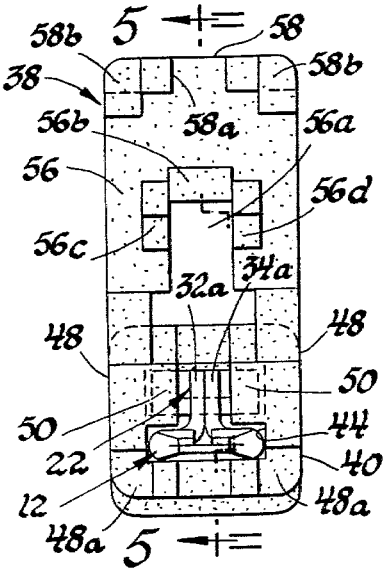
FIGS. 7 and 8 are front and top views respectively of the electric connector with the connector body flap shown in an open position as in FIG. 5.
Figure 8:
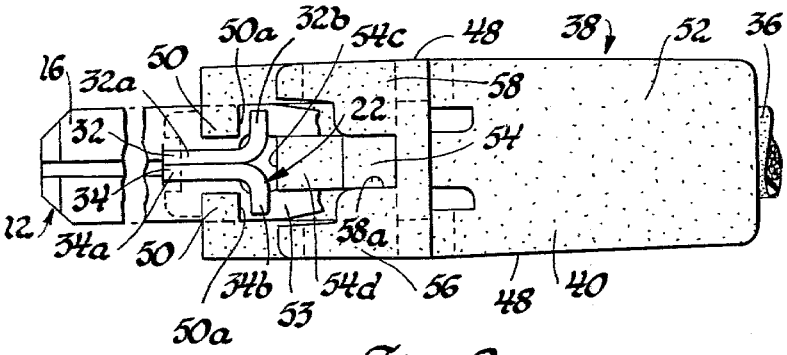
Figure 9:
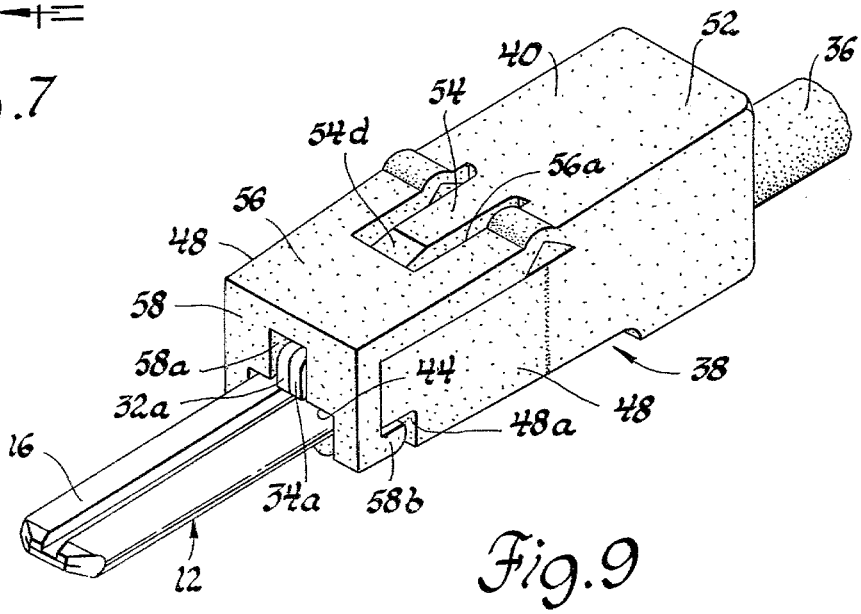
FIG. 9 is a perspective view of the electric connector with its secondary lock flap in the closed position as shown in FIG. 6.

The connector body 40 further includes a flap 56 which is integrally hinged at the front of the top wall 52 and which is movable between an open position shown in FIGS. 5, 7 and 8 and a closed position shown in FIGS. 6 and 9 where it covers the transverse opening 53 in the front half of the connector body 40. The flap 56 has a longitudinal slot 56*a*, a beveled surface 56*b* immediately forward of the longitudinal slot 56*a* which matches the external beveled surface 54*d*, and studs 56*c* and 56*d* on either side of the slot 56*a*.

The flap 56 also has a front flange 58 which has a T-shaped slot 58*a* and hooks 58*b*. The T-shaped opening 58*a* in the front flange 58 more or less coincides with the front opening 44 of the connector body 40 and permits the blade contact 16 and longitudinal section legs 32*a*, 34*a* to project through the flange as best shown in FIG. 9. The hooks 58*b* fit in notches 48*a* at the lower front ends of the side walls 48 to lock the flap 56 in the closed position.

In the closed position, the longitudinal slot 56*a* accommodates the flexible latch finger 54 and also holds the flexible latch finger 54 down in its terminal retaining position. Specifically, the beveled surface 56*b* of the flap 56 engages the external beveled surface 54*d* as best shown in FIG. 6. This maintains the depending portion 54*a* of the flexible latch finger 54 in the terminal cavity 42 so that the lock shoulder 54*c* is always behind the rigid lock projection 22 to prevent the terminal 12 from being pulled out of the connector body 40. The studs 56*c*, 56*d* are aligned with the tongue end portion 54*a* and are positioned behind the respective section legs 32*b*, 34*b* when the flap 56 is closed. The studs 56*c*, 56*d* thus act as a secondary lock which retains the terminal 12 in the cavity 42 in the event that the flexible latch finger 54 becomes damaged or inoperable for one reason or another.

I wish it to be understood that I do not desire to be limited to the exact details of construction shown and described, for obvious modifications will occur to a person skilled in the art.

The embodiments of the invention in which an exclusive property or privilege is claimed are defined as follows:

1. In a connector body having a terminal receiving cavity and a flexible latch finger for retaining a terminal in the terminal receiving cavity, the improvement comprising:

said connector body having an exterior wall which provides a transverse opening into the terminal receiving cavity, said flexible latch finger being attached to said exterior wall and extending into the transverse opening in cantilever fashion, and having an end portion which projects into the terminal receiving cavity for retaining a terminal therein when the latch finger is in a normal position, and a flap hinged to said exterior wall which is movable between an open position and a closed position, said flap engaging the resilient latch finger in its closed position to maintain the resilient latch finger in its normal position.

2. In a connector body having a longitudinal terminal receiving cavity and a flexible latch finger for retaining a terminal in the terminal receiving cavity, the improvement comprising:

said connector body having an exterior longitudinal wall which provides a transverse opening into a forward portion of the terminal receiving cavity, said flexible latch finger being attached to said exterior wall and extending forwardly into the transverse opening in cantilever fashion, said flexible latch finger when in a normal position lying within the plane of the exterior wall except for a depending portion which projects into the terminal receiving cavity for retaining a terminal therein, and a slotted flap hinged to said exterior wall which is movable between an open position and a closed position surrounding the flexible latch finger, said flap having a beveled surface which engages an external beveled surface at the free end of the resilient latch finger when the flap is in its closed position whereby the resilient latch finger is maintained in its normal position when the flap is in its closed position.

3. In a connector body having a longitudinal terminal receiving cavity and a flexible latch finger for retaining a terminal in the terminal receiving cavity, the improvement comprising:

said connector body having an exterior longitudinal wall which provides a transverse opening into a forward portion of the terminal receiving cavity, said flexible latch finger being attached to said exterior wall and extending forwardly into the transverse opening in cantilever fashion, said flexible latch finger when in a normal position lying within the plane of the exterior wall except for a depending portion which projects into the terminal receiving cavity for retaining a terminal therein, and a flap hinged to said exterior wall which is movable between an open position and a closed position where it engages an external surface at the free end of the resilient latch finger to maintain the resilient latch finger in its normal position, said flap having a slot which accommodates the flexible latch finger and stud means which are aligned with the depending portion of the flexible latch finger when the flap is in its closed position.

4. In an electric connector which includes a terminal and a connector body having a longitudinal open-ended cavity and a flexible latch finger which engages a relatively rigid portion of the terminal after it is inserted into the cavity to retain the terminal in the cavity, the improvement comprising:

said connector body having an exterior longitudinal wall which provides a transverse opening into the cavity, said flexible latch finger being attached to the exterior wall and extending into the transverse opening in cantilever fashion, said latch finger having a depending portion at one end, said terminal having a relatively rigid projection which is engaged by the depending portion of the flexible latch finger to prevent withdrawal of the terminal after it is fully inserted into the cavity, and a flap hinged to the exterior wall of the connector body and movable between an open position and a closed position where it engages and holds down the flexible latch finger so that the depending portion of the flexible latch finger projects into the cavity behind the rigid projection of the terminal in its normal position.

* * * * *